US010568380B2

(12) United States Patent
Salvetti et al.

(10) Patent No.: US 10,568,380 B2
(45) Date of Patent: Feb. 25, 2020

(54) PROTECTING HELMET WITH RAISING/LOWERING MECHANISM OF THE VISOR

(71) Applicant: NOLANGROUP S.p.A., Brembate di Sopra (IT)

(72) Inventors: Alberto Salvetti, Bergamo (IT); Danilo Ferreri, Brembate di Sopra (IT)

(73) Assignee: NOLANGROUP S.P.A., Brembate di Sopra (BG) (IT)

( * ) Notice: Subject to any disclaimer, the term of this patent is extended or adjusted under 35 U.S.C. 154(b) by 277 days.

(21) Appl. No.: 15/233,127

(22) Filed: Aug. 10, 2016

(65) Prior Publication Data

US 2017/0215508 A1 Aug. 3, 2017

(30) Foreign Application Priority Data

Aug. 18, 2015 (IT) ..... 102015000045191

(51) Int. Cl.
*A42B 3/22* (2006.01)
*A42B 3/12* (2006.01)

(52) U.S. Cl.
CPC ..... *A42B 3/223* (2013.01); *A42B 3/125* (2013.01); *A42B 3/226* (2013.01)

(58) Field of Classification Search
CPC ..... A42B 3/223; A42B 3/222; A42B 3/22; A42B 3/221; A42B 3/18; A42B 3/227; A42B 3/225

(Continued)

(56) References Cited

U.S. PATENT DOCUMENTS 4,571,747 A * 2/1986 Briggs ..... A42B 3/223 2/10
4,794,652 A * 1/1989 Piech von Planta .. A42B 3/222 2/12

(Continued)

FOREIGN PATENT DOCUMENTS

EP 1856999 A2 11/2007
EP 2517586 A2 10/2012

OTHER PUBLICATIONS

International Search Report and Written Opinion for Italian Application No. UB20153158 (dated Apr. 26, 2016) (7 Pages).

*Primary Examiner* — Sally Haden
*Assistant Examiner* — Jillian K Pierorazio
(74) *Attorney, Agent, or Firm* — Lucas & Mercanti, LLP

(57) ABSTRACT

Protecting helmet of the type provided with at least one inner shell for shock absorption and at least one outer rigid shell that define a front opening for the face of a user, as well as a protective visor at least rotatable between a lowered position intercepting, at least partially, the front opening and a raised position disengaged from said front opening, and a raising/lowering mechanism to raise/lower the protective visor, wherein the raising/lowering mechanism comprises:

at least one base member integral with, or made in a single piece with, or coincident with, part of the outer shell, and arranged in a side position with respect to said front opening;

a lever body mounted on said outer shell or said base member so as to rotate around a first axis and provided with a support swinging with respect to said first axis between a proximal position and a distal position with respect to said front opening, said support further comprising hooking means to hook with a corresponding side area of the protective visor;

(Continued)

elastic return-means constrained to said outer shell or said base member, and acting on said lever body to push it towards its distal position;

one or more hooking teeth integral with said side area of the protective visor and shaped for the engagement with said hooking means of the lever body;

at least one guide cam and a respective follower projection engaged with said guide cam, said at least one guide cam being integral with said at least one base member, and said respective follower projection being constrained so that to integrally rotate with said first side area of the protective visor, or vice versa.

Advantageously, the support of the lever body comprises at least one multiple-seat profile and the raising/lowering mechanism further comprises an intermediate disc-shaped element coupled with the afore said support of the lever body so that to rotate with respect to such support around a second axis, and also to swing with respect to the above mentioned first axis integrally with the support of the lever body. The intermediate disc-shaped element further comprises constraining means for the removable constraint to at least one of said hooking teeth of the protective visor in order to transmit at least the circular motion of the protective visor, during the raising or lowering thereof, to the same intermediate disc-shaped element, as well as engaging means, at least integrally rotatable with the same intermediate disc-shaped element, for the movable snap fitting with the afore mentioned at least one multiple-seat profile of the support of the lever body.

15 Claims, 5 Drawing Sheets

(58) Field of Classification Search
USPC ..... 2/411, 424, 441, 422
See application file for complete search history.

(56) References Cited

U.S. PATENT DOCUMENTS

| | | | | |
|---|---|---|---|---|
| 6,264,392 | B1 * | 7/2001 | Wise | A42B 3/225 16/342 |
| 8,214,919 | B2 * | 7/2012 | Gafforio | A42B 3/223 2/410 |
| 2006/0064799 | A1 | 3/2006 | Dion | |
| 2011/0094019 | A1 * | 4/2011 | Isobe | A42B 3/222 2/424 |
| 2011/0121023 | A1 * | 5/2011 | Milan | B65D 79/02 222/23 |
| 2012/0144566 | A1 * | 6/2012 | Hunt | A42B 3/223 2/422 |
| 2015/0074877 | A1 * | 3/2015 | Huh | A42B 3/222 2/422 |

* cited by examiner

PROTECTING HELMET WITH RAISING/LOWERING MECHANISM OF THE VISOR

CROSS-REFERENCE TO RELATED APPLICATIONS

This application claims the benefit of Italian Patent Application No. 102015000045191 filed Aug. 18, 2015.

FIELD OF THE INVENTION

The present invention relates to a protecting helmet, for example of the type used in the motor field and, in particular, with vehicles without passenger compartment, the helmet comprising at least one inner shell for shock absorption and one outer rigid shell that define a front opening for the face of a user, as well as a visor able to be raised and lowered with respect to this front opening, thanks to a respective mechanism.

In more detail, the present invention relates to a protecting helmet provided with an inner shell for shock absorption, made for example of expanded polystyrene, an underlying padding made for example of foam rubber, an outer rigid shell, for example of fiber or polycarbonate, and at least one protective visor, usually made of transparent polycarbonate and constrained to the outer shell by means of a respective raising/lowering mechanism for allowing the visor to at least rotate between a lowered position intercepting, at least partially, the front opening and a raised position disengaged from the latter.

BACKGROUND OF THE INVENTION

It is known in the art to equip protecting helmets, in particular for motorcycle use or generally for motoring use, with a raising/lowering mechanism to raise/lower the protective visor with respect to the front opening of the helmet, the mechanism allowing the visor not only to rotate around a given axis, but also either to translate or further rotate around a different axis, with respect to the outer shell of the helmet itself, so as to define positions in which the visor is closer to or farther from the outer shell or seals normally surrounding the afore said front opening of the helmet.

This makes it possible to ensure that the visor, when completely lowered, is close to the outer shell and adheres to the seals delimiting the front opening while ensuring, at the same time, that the distance between the visor and seals allows a proper inflow of air inside the helmet when the visor is raised to an intermediate position in which it partially intercepts the front opening, and further ensuring that the visor, when completely raised, can remain in close proximity of the outer shell thereby reducing both the bulk and the surface of incidence stricken by the airflow during vehicle motion.

Moreover, such a raising/lowering mechanism may also allow the visor, when in its fully lowered position, to be arranged flush with the ends of the outer shell that surround the afore said front opening, and at the same time to be easily raised by the user thanks to the translation, enabled by this raising/lowering mechanism, of the protective visor itself away from the front opening.

It should be noted that hereinafter, for the sake of simplicity, the protective visor of the helmet is considered to be in its fully lowered position when it completely, or almost completely, covers the above said front opening of the helmet and, on the contrary, to be in its completely raised position when it does not interfere at all, or nearly so, with such front opening.

The European Patent Application EP-A-0797935, in the name of EDC, describes a raising/lowering mechanism to raise/lower the protective visor of a motorcyclist helmet, the mechanism being able to impart to the visor a rotatory-translatory motion according to a substantially elliptic trajectory such that the protective visor is closer to the outer shell of the helmet at least in its completely lowered position and is instead farther from the outer shell in intermediate raised positions. In practice, such mechanism provides that each of the side ends of the protective visor is constrained to the outer shell of the helmet by means of a suitably designed four-bar linkage to allow the visor, in its completely lowered position, to be in close contact with the outer shell and to be instead spaced from the outer shell itself in its other raised positions.

This solution however shows, although extremely effective, in addition to albeit limited structural complexity, a certain lack of flexibility as regards the adaptation of the law of motion imparted by the lifting/lowering mechanism to the protective visor, when the overall geometry of the helmet varies. In fact, the law of motion imparted to the protective visor by the raising/lowering mechanism can be modified only by changing the geometry of the four-bar linkage and, in particular, the dimensions of the respective cranks.

The Patent Application EP-A-1856999, in the name of SHOEI, relates to a raising/lowering mechanism to raise/lower the protective visor of a protecting motorcycling helmet which provides, on the outer shell of the helmet, a base member fastened on either side of the front opening and a movable body constrained to the base member so as to be able to translate back and forth with respect to the front opening of the helmet and to which a side end of the protective visor is rotatably constrained. A cam and a relevant follower, both respectively integral with the visor and the base member or vice versa, cause the protective visor, during the raising thereof, to translate in a controlled way closer to or away from the outer shell.

This solution, allowing a combined movement of translation and rotation of the protective visor simple to be implemented, even if affected by a considerable structural complexity, is efficient and fairly adaptable to the different geometries of the protecting helmet thanks to the fact that, just changing the profile of the cam, the law of motion of the protective visor can be varied to a certain extent.

The Korean Patent KR-A-20-2003-0040194, in the name of KIDO, relates to a raising/lowering mechanism to raise/lower a protective visor of a protecting helmet comprising at least one base member integral with the outer shell of the helmet at a side area of the front opening of the helmet itself, which is provided with a toothed guide profile and to which a lever body is pivoted and provided with hooking means to hook with a side end of the protective visor itself. The lever body is forced into a rest position by a return spring interposed between the base member and the lever body itself. A dedicated follower pin, obtained on the same side end of the protective visor hooked to the lever body, engages with the toothed guide profile of the base member in such a way that the rotation of the protective visor during the raising/lowering thereof, depending on the shape of the toothed guide profile and overcoming the resistance given by the afore said return spring, causes both the lever body to swing with respect to the base member and the protective visor itself to move away from or closer to the outer shell of the helmet.

Although the solution of KIDO Patent is structurally simple and mechanically efficient, it shows the drawback that the follower pin, engaged in the depressions of the toothed guide profile, is constantly subject to the load applied both by the visor and the return spring of the lever body and, therefore, requires an overdimensioning.

It is an object of the present invention to realize a protecting helmet provided with a raising/lowering mechanism to raise/lower the protective visor, the mechanism allowing the visor itself to roto-translate or rotate effectively around multiple axes in a simply and structurally not complex way and being able to easily adapt to possible geometrical changes of the protecting helmet itself.

It is another object of the present invention to provide a protecting helmet having a raising/lowering mechanism to raise/lower the protective visor, the mechanism allowing the latter, during the raising and lowering thereof, to move closer to and away from the outer shell of the helmet and not having the drawbacks of the known prior art.

It is a further object of the present invention to realize a protecting helmet which allows an effective management of the raising and lowering of the respective protective visor by means of a respective raising/lowering mechanism which is easy to be implemented on the helmet itself.

SUMMARY OF THE INVENTION

The protecting helmet, according to the first independent claim and the following claims depending therefrom, achieves these and other objects.

The protecting helmet according to the present invention comprises at least one inner shell for shock absorption and at least one outer rigid shell which, together, define at least one front opening for the face of a user as well as a protective visor at least rotatable between a lowered position intercepting, at least partially, the front opening and a raised position disengaged from such front opening, and a raising/lowering mechanism to raise/lower the protective visor. The raising/lowering mechanism comprises in turn:

- at least one base member integral with the outer shell or made in a single piece therewith, coincident with part of the outer shell and arranged in a side position with respect to the front opening of the helmet;
- an elongated lever body mounted at an end thereof on the outer shell or the base member so as to rotate around a first axis and further provided, at the other end thereof, with a preferably substantially circular support swinging with respect to such first axis between a proximal position and a distal position with respect to the front opening of the helmet. This support of the elongated lever body further comprises hooking means to hook with a corresponding side area of the protective visor;
- elastic return-means, for example a helical spring constrained to the outer shell and/or the above said base member, and acting on the elongated lever body to push it towards its so-called distal position;
- one or more hooking teeth integral with the above said side area of the protective visor and shaped for the engagement with the hooking means of the elongated lever body;
- a guide cam integral with the base member and a follower projection constrained so as to integrally rotate with this side area of the protective visor and adapted to engage with this guide cam, or vice versa a guide cam constrained so as to integrally rotate with the above said side area of the protective visor and the respective follower projection integral with the base member and adapted to engage with the guide cam.

Advantageously, the protecting helmet according to the present invention provides that the above said support of the elongated lever body comprises at least one multiple-seat profile, such as for example a toothed profile, and that the raising/lowering mechanism further comprises an intermediate disc-shaped element coupled with, and preferably constrained to, the support of the lever body so that to rotate with respect to said support around a second axis, and also to swing with respect to the first axis integrally with such support. Such intermediate disc-shaped element further comprises constraining means for the removable constraint to at least one of the hooking teeth of the protective visor in order to transmit at least the circular motion of the protective visor, during the raising or lowering thereof, to the same intermediate disc-shaped element, as well as engaging means at least integrally rotatable with the same intermediate disc-shaped element, for the movable snap fitting with the afore said at least one multiple-seat profile.

As the person skilled in the art will understand, in a protecting helmet of the type provided with a raising/lowering mechanism to raise/lower the visor in which the visor substantially rotates around two parallel axes, a better reliability of the entire mechanism, together with high effectiveness of the same raising/lowering mechanism to raise/lower the visor are achieved, thanks to the fact that stable intermediate positions of raising/lowering of the visor, defined by the above mentioned multiple-seat profiles, are obtained without directly engaging any element/component integral with the protective visor.

According to a preferred aspect of the present invention, the raising/lowering mechanism to raise/lower the protective visor may further comprise a pin and/or a mounting bush for retaining axially, i.e. along a direction orthogonal or incident to the outer shell of the helmet, the lever body and the intermediate disc-shaped element in stable connection with the afore said base member. In this case, in order to allow the swing of the support of the lever body and thus of the intermediate disc-shaped element, both the lever body and the intermediate disc-shaped element comprise elongated slots for the passage of this pin or mounting bush.

In a particular embodiment of the present invention, the hooking means to hook the lever body to a respective side area of the protective visor are of reversible type and comprise at least one fitting seat for at least one hooking tooth of the protective visor. In particular, such fitting seat may be provided with an inlet that a manually operated elastic cursor can partially and selectively occlude.

Furthermore, according to another preferred aspect of this invention, at least one of the afore mentioned hooking teeth of the protective visor can be provided with arched shoulders for its centering in a respective fitting seat, the latter being also arched or otherwise having a circular development, of which said support of the lever body is provided with.

According to a further aspect of the present invention, the afore said engaging means for the snap fitting of which the intermediate disc-shaped element is provided with, comprise at least one piston bidirectionally sliding within limits in a respective radial guide and a thrust spring acting on this piston.

In a preferred embodiment of the present invention, the protecting helmet is further provided with a second antiglare visor that can be raised and lowered by a manually operated lever.

BRIEF DESCRIPTION OF THE DRAWINGS

These and other aspects of the present invention will be described herein in more detail, by way of example only and without any restrictive intent, with reference to the accompanying figures, in which.

DETAILED DESCRIPTION OF A PREFERRED EMBODIMENT OF THE INVENTION

Figure 1:
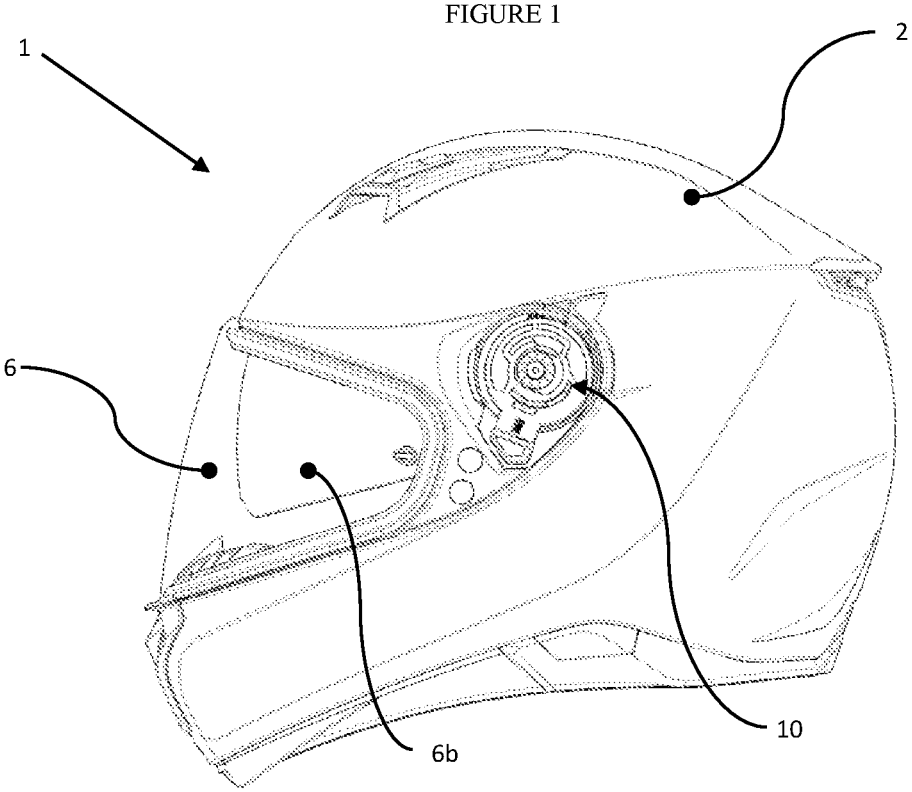
FIG. 1 is a side view of a protecting helmet comprising a raising/lowering mechanism to raise/lower the protective visor according to a particular aspect of the present invention.
Figure 2B:
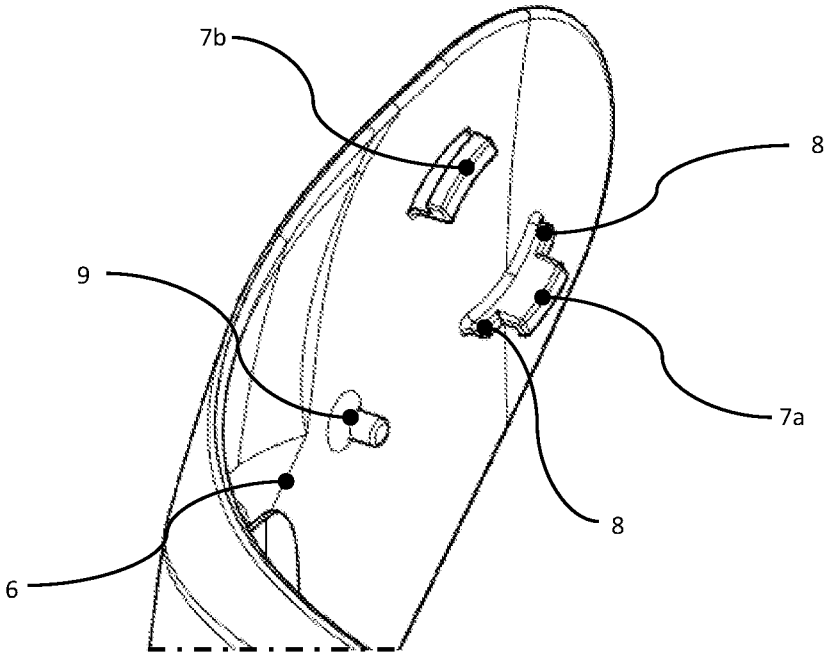
FIG. 2*b* is an enlarged view of a side portion of the protective visor of the protecting helmet shown in FIG. 1.
Figure 2A:
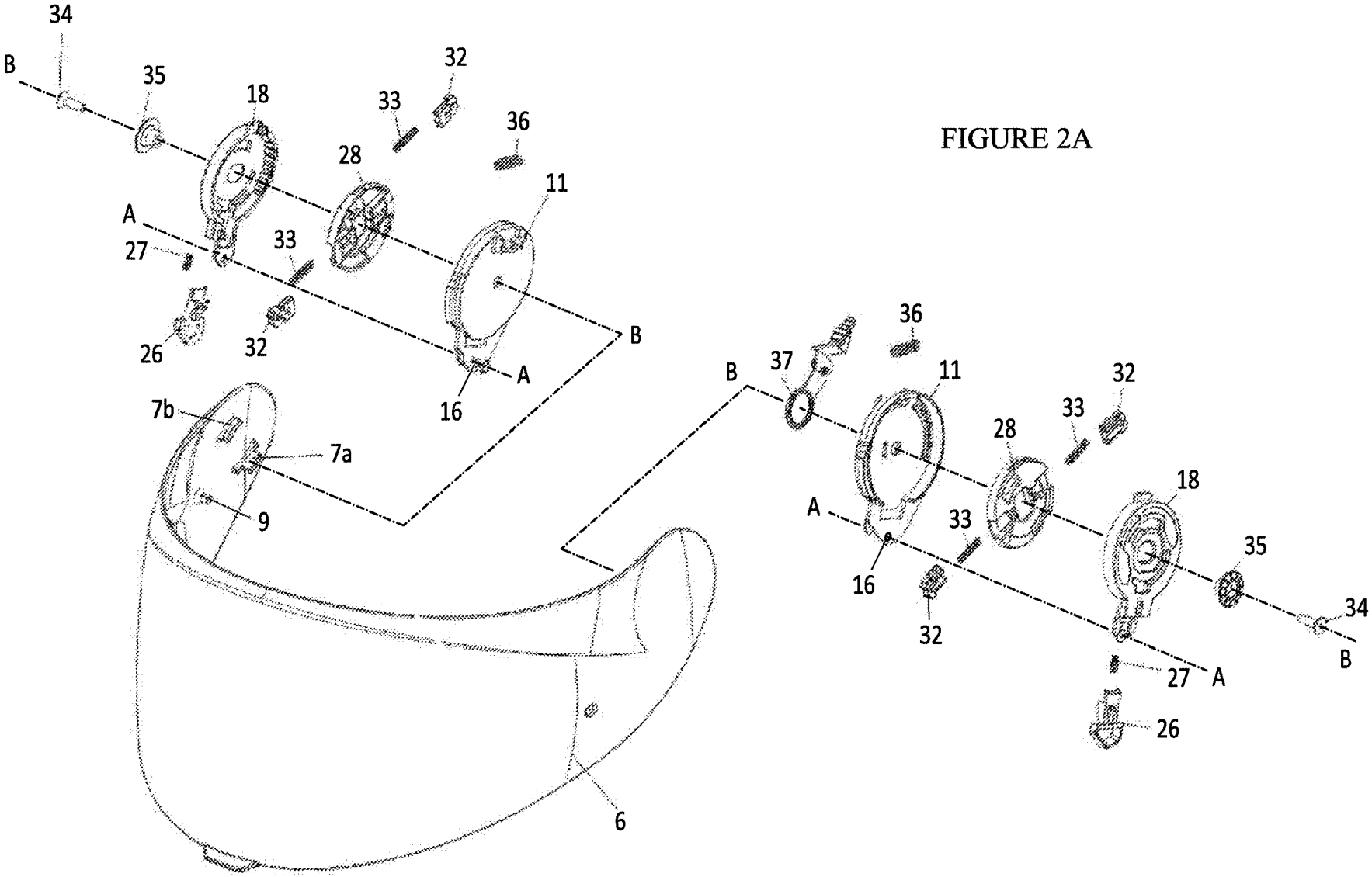
FIG. 2*a* is an exploded view of part of the protecting helmet of FIG. 1, according to a preferred aspect of the present invention.
Figure 3:
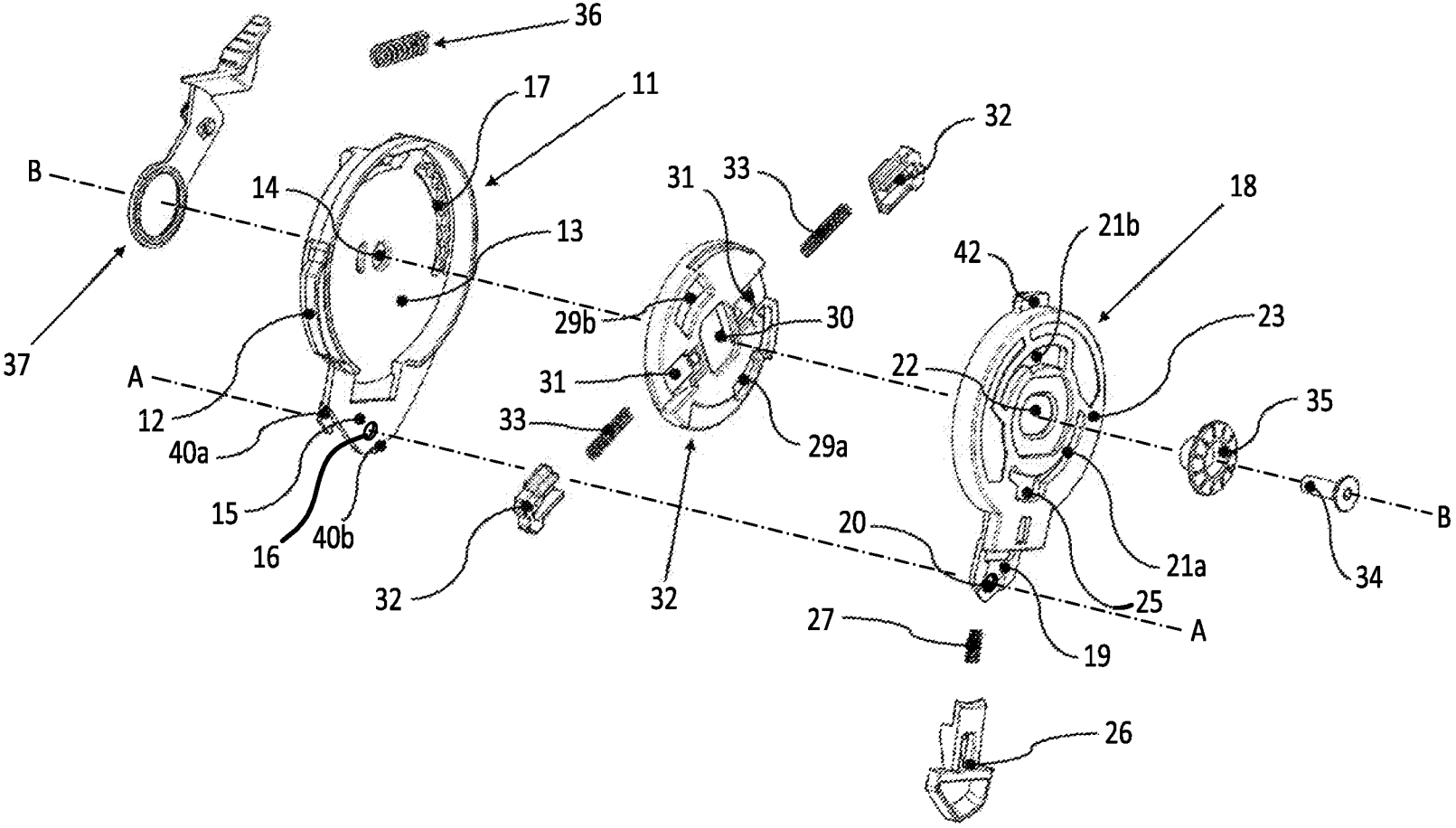
FIG. 3 is an exploded view from the outer side, i.e. taken from the side intended to be visible once coupled with the shell of the protecting helmet, of the raising/lowering mechanism of the helmet of FIG. 1.
Figure 4:
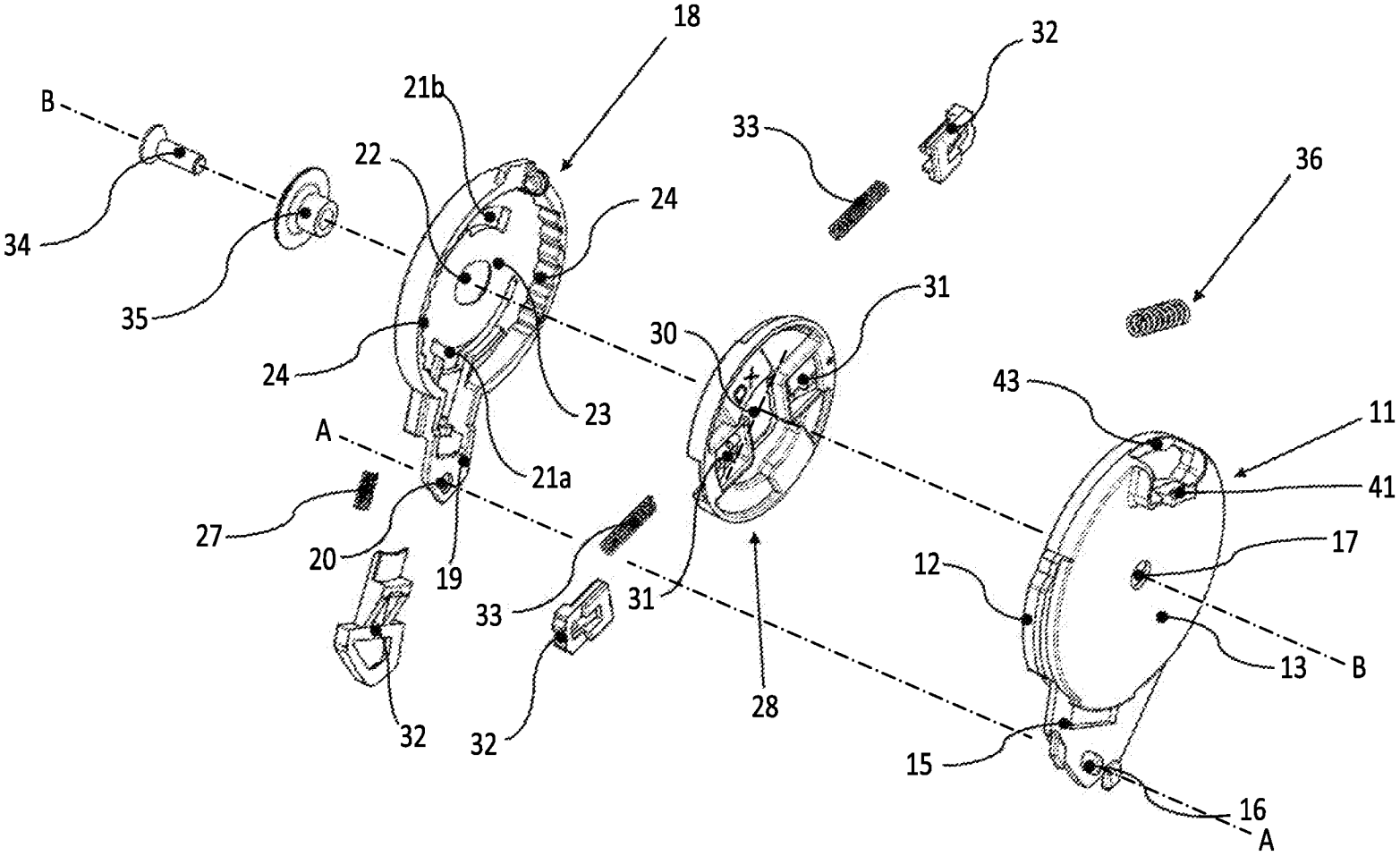
FIG. 4 is an exploded view from the inner side, opposite to the one of FIG. 3, of the raising/lowering mechanism of the helmet of FIG. 1.

Generally referring to the accompanying figures, the protecting helmet 1 according to the present invention, preferably suitable to be used with vehicles without passenger compartment such as motorcycles or snowmobiles, comprises according to the known art an outer rigid shell 2, for example made of polycarbonate or glass fiber or Kevlar, an underlying inner shell 3 made of a material capable of absorbing shocks, such as expanded polystyrene, and a padding 4, for example made of foam rubber, placed under the inner shell 3 and adapted to make the helmet 1 comfortable for the user.

The inner shell 3 for shock absorption and the outer rigid shell 2 define at least one front opening 5 of the protecting helmet 1 leaving uncovered part of the face, particularly the eyes, of the user of the helmet 1, and being apt to be at least partially covered by a protective visor 6 usually transparent that is constrained to the outer shell 2 of the helmet itself so as to at least rotate.

Such protective visor 6, usually made of a polymer material such as polycarbonate, is constrained to the outer shell 2 of the protecting helmet 1 by means of a raising/lowering mechanism 10 to raise/lower the visor 6 itself, the mechanism being of the type adapted to allow the protective visor 6 to be raised and lowered between a position intercepting, at least partially and preferably completely, the front opening 5 of the helmet 1 and a position completely or almost completely disengaged from such front opening 5. As known, the afore said intercepting position taken by the visor 6 coincides with the completely lowered position, whereas the afore said disengaged position corresponds to the completely raised position of the visor 6 itself.

The raising/lowering mechanism 10 of the helmet 1, according to a particular aspect of the present invention and as will be better seen hereinafter, not only allows the visor 6 to be reversibly hooked to and released from the helmet 1, but also allows other movements of the protective visor 6, in particular towards and away with respect to the outer shell 2 of the same protecting helmet 1.

On at least one area of the outer shell 2 located on one side of the front opening 5, but preferably on each of the areas of the outer shell 2 located at both sides of the front opening 5, such raising/lowering mechanism 10 provides a base member 11 intended to be integrally constrained to the outer shell 2 and comprising a guide cam 12 constituted by a curved projection which, when the base member 11 is made integral with the outer shell 2, extends transversely and preferably orthogonally with respect to the rotation axis of the protective visor 6 and which is provided with elevated or depressed portions with respect to the curved surface from which the projection rises up.

As will be seen, the guide cam 12 is intended to engage with a follower projection 9 of which the side end of the protective visor 6, corresponding to the base member 11, is provided with. Generally the guide cam 12, integral with the base member 11, can engage with a follower projection 9 constrained, even indirectly, to the protective visor 6 so as to integrally rotate with the visor 6 itself or, as an alternative, the follower projection 9 can be integral with the base member 11 and the guide cam 12 can be constrained so as to integrally rotate with the protective visor 6.

More particularly, such base member 11 comprises a substantially circular housing 13 having a cylindrical shape, in which a hole 14 is located for fastening the base member 11 itself to the outer shell 2, for example by a rivet 34 or threaded means, and having on its outer walls the afore said guide cam 12.

In the embodiment shown herein of the base member 11, it further comprises a recess 15 intended to engage with an end 19 of a lever body 18 which the mechanism 10 is provided with, as will be seen later.

Optionally, if the protecting helmet 1 also comprises a second antiglare visor 6*b*, the housing 13 may comprise, on the inner portions thereof, a curved rack 17 in order to allow such possible antiglare visor 6*b* to reach a set of stable positions by means of a follower snap-fit coupled with such rack 17 and rotationally integral with the same antiglare visor 6*b* or with a lever 37 to operate the latter.

It should be noted that, although it is described a base member 11 made as a body separate from the outer shell 2 of the helmet 1, for example a polymeric body, any other embodiment of such a base member 11, as long as provided with the afore said guide cam 12, even made in one piece on the same outer shell 2 and for example forming a shaped portion of this shell 2, falls within the protection scope required herein.

The raising/lowering mechanism 10 to raise/lower the protective visor 6 further comprises, as mentioned, an elongated lever body 18 preferably made up of a support 23, preferably in the form of a concave tubular body with a substantially circular base, and a radial extension 19 provided at its end with a pivot hole 20.

In particular, the lever body 18 is shaped so as to be rotationally constrained to the outer shell 2 and/or to the base member 11 through the pivot hole 20, thereby allowing the support 23 to swing with respect to a first axis A-A coincident with the axis of the hole 20 and substantially orthogonal to the surface of the outer shell 2, between a position, herein named proximal, in which such support 23 is closer to the front opening 5 and a position, hereinafter named distal, in which the support 23 is further away from such front opening 5.

In a preferred embodiment of the present invention, such lever body 18 further comprises a projection 42, for example and preferably elastically deformable, placed at the opposite end with respect to the hole 20 and adapted to engage, also in a circumferentially sliding manner, with a respective axially retaining wall 43 which the base member 11 can be provided with, in order to allow the axial constraint between such lever body 18 and the base member 11 itself during the assembly of the mechanism 10.

It should be noted that, in the particular embodiment of the present invention described herein, the lever body 18 is pivoted to the base member 11 by a pin 16 that is at the recess 15 of the base member 11 itself. The recess 15 can also define the maximum angular extent of the swing around the axis A-A of the lever body 18 and therefore of the respective support 23, for example by means of containment walls adapted to engage the afore said radial extension 19 of the lever body 18 itself. Of course, any other mechanical constraint allowing the lever body 18 to swing so as to allow the respective support 23 to rotate around the axis A-A, between the afore said two distal and proximal positions with respect to the front opening 5 of the helmet 1, can be alternatively implemented.

Such lever body 18 is further subject to elastic means, preferably a helical spring 36 interposed between the base member 11, or the outer shell 2, and the lever body 18 itself, the elastic means returning the lever body 18 swinging around the axis A-A to its distal position, i.e. further away from the front opening 5 of the protecting helmet 1.

As mentioned, according to a particular aspect of the present invention, the support 23 of the lever body 18 is made as a concave tubular body having a substantially circular base and comprising a cylindrical side wall having on the top thereof an outer circular base. On the base of this external support 23 two seats 21*a*, 21*b* shaped as circle arc are obtained and intended for the fitting of respective hooking teeth 7*a*, 7*b*, which the corresponding end of the protective visor 6 is provided with. Such fitting seats 21*a*, 21*b* are shaped so as to also act as housings having a circular development and being adapted to allow the protective visor 6 to rotate with respect to the lever body 18 around a second axis B-B, that is substantially orthogonal to these fitting seats 21*a*, 21*b* and passes through the center of the ideal circle on which such seats, or housings 21*a*, 21*b*, lie, thereby allowing the corresponding hooking teeth 7*a*, 7*b* to further slide during the relative rotation of the visor 6 with respect to the lever body 18.

In this way, the protective visor 6, once hooked to the lever body 18 as described above, may rotate around the axis B-B defined by the fitting seats 21*a*, 21*b*, with respect to the support 23 of the lever body 18 itself and may also rotate, integrally with the lever body 18, with respect to the pivot axis A-A in which the same lever body 18 is pivoted to the base member 11.

It should be noted that, as an alternative to the solution shown herein, the support 23 of the lever body 18 can be provided with at least only one housing 21*a* or 21*b* having circular development, at least one of the hooking tooth of the visor 6 being able to rotate in a relative way within this housing although not necessarily being retained therein.

As known in the art and according to a preferred embodiment of the present invention, each of the two circle-arc-shaped fitting seats 21*a*, 21*b*, or housings, has a larger section, named herein "inlet", adapted to allow the access of a respective hooking tooth 7*a*, 7*b*. In fact, each of these hooking teeth 7*a*, 7*b* of the protective visor 6 extends in the axial direction from the corresponding side area of the visor 6, i.e. in the direction of the rotation axes of the same visor 6, and has a substantially L-shaped profile such that it can be coupled with the respective fitting seat 21*a*, 21*b* only if there is an opening, i.e. a larger section, which allows the entrance of the end portion of the "L".

In order to allow the hooking teeth 7*a*, 7*b* to be retained, though reversibly, in the afore said fitting seats 21*a*, 21*b*, at least one seat 21*a* of these two seats 21*a*, 21*b* comprises an inlet 25 intended to be partially and selectively occluded by a cursor 26 sliding in a direction transverse to the rotation axis of the protective visor 6 and being pushed by a spring 27, or other elastic means known in the art, so as to engage with such inlet 25.

The cursor 26, that in its end engaging with the inlet 25 has a tapered portion to help the respective hooking tooth 7*a* to be pushed and entered therein, further comprises a shaped portion intended to be manually operated by the user to counter the force applied by the spring 27.

Therefore, the fitting seats 21*a*, 21*b* together with the respective inlets and, optionally, with the elastic cursor 26, 27 or other known means allowing the afore said hooking teeth 7*a*, 7*b* to be reversibly retained in engagement with the fitting seats 21*a*, 21*b*, make up reversible hooking means to hook the lever body 18 to the respective side area of the protective visor 6.

It should be noted that, as an alternative to the above illustrated solution, any other means for reversibly retain the protective visor 6 to the lever body 18 and allowing the protective visor 6 itself to rotate with respect to the lever body 18 around an axis B-B while swinging together with the lever body 18 around an axis A-A, substantially parallel to the axis B-B, falls within the protection scope required herein. In this regard it should be noted that, hereinafter, "hooking tooth" means any portion or element of the visor 6, not necessarily projecting or L-shaped, geometrically shaped to engage with the lever body 18 so as to rotate with respect to the latter around the axis B-B and to swing with it around the axis A-A. And therefore such term can mean for example also a key-shaped cylindrical sleeve projecting axially from the side end of the visor 6, or an arm of a "fork-shaped" or "U-shaped" end that thereby extends orthogonal to the rotation axis B-B of the visor 6 itself.

The support 23 of the lever body 18 also includes a central slot 22, inside which the aforementioned rotation axis B-B of the protective visor 6 passes, the support being shaped to engage with a bushing 35 retained for example by a rivet 34 fastened to the outer shell 2 and intended to ensure that the lever body 18 is suitably constrained to the outer shell 2 itself of the helmet 1 so as to rotate around the axis A-A, thanks to the elongated shape of the slot 22 itself, and at the same time so as not to be axially released from such coupling with the outer shell 2.

According to a preferred aspect of the present invention, the bushing 35 together with the respective rivet 34, or else any other pin or elongated element optionally threaded, axially constrained to the outer shell 2, further cause the base member 11 to be axially fastened to the same outer shell 2 thanks to the engagement of the rivet 34, or another elongated element fastened to the outer shell 2, through the above-mentioned circular hole 14 of which the substantially circular housing 13 of the base member 11 is provided with.

It should be noted that, according to a preferred aspect of this invention, the base member 11 also has lower protuberances 40*a* and 40*b* as well as an upper elastic hooking tooth 41 all of which can fit into appropriate corresponding slits provided on the side ends of the outer shell 2; thereby the base member 11 is positioned on the outer ends of the shell in a temporary and/or removable way by the elastic snap fitting of the above mentioned teeth 40*a*, 40*b* and 41.

Subsequently, the same base member 11 is axially secured to the shell 2 by means of the bushing 35 with its rivet 34 or other similar axial constraining means.

As mentioned, thanks to the lever body 18 described herein, the protective visor 6, once hooked to the lever body 18 itself, can then rotate with respect to the support 23 of the lever body 18 itself around the axis B-B defined by the circle-arc-shaped fitting seats 21*a*, 21*b*, and can also rotate, or better swing, integrally with the lever body 18 around the axis A-A on which the same lever body 18 is pivoted to the base member 11, and therefore to the outer shell 2. The bushing or pin 35, or other elongated element, and also the slot 22 of the lever body 18 within which the bush or pin 35 engages for axially retaining the same lever body 18, must all be shaped so as to allow the rotations of the protective visor 6 with respect to both the afore said axes A-A and B-B.

At least on one inner section of the side wall of the support 23, the latter being made as a concave tubular body in the particular embodiment shown herein, there is a multiple-seat profile 24 preferably shaped as a rack, intended to define a plurality of stable positions for the protective visor 6 during the raising/lowering thereof, as will be seen later. In particular, in the embodiment described herein, inside the support 23 there are two multiple-seat profiles 24 diametrically opposite with respect to the rotation axis B-B defined by the fitting seats 21*a*, 21*b* and having a circular development.

According to an aspect of the present invention, the raising/lowering mechanism of the protecting helmet 1 described herein further comprises an intermediate disc-shaped element 28 shaped so as to couple with, or be constrained to, the support 23 of the lever body 18 so that to rotate, and in particular rotate around the afore said second axis B-B defined by the above mentioned fitting seats 21*a*, 21*b* of the support 23 itself.

In more detail, such intermediate disc-shaped element 28 is mounted to be arranged between the base member 11 and the lever body 18 so as to be able to rotate around the axis B-B and to swing, at the same time, together with the lever body 18 around the axis A-A. In particular, the disc-shaped element 28 is housed in the concave tubular support 23 of the lever body 18.

In the particular embodiment shown herein, the intermediate disc-shaped element 28 having a substantially circular shape, comprises a central elongated slot 30 intended to engage with the above described bushing 35 and rivet 34, and also two hollows 29*a*, 29*b* diametrically opposite with respect to the center of the disc-shaped element and intended to engage with the respective hooking teeth 7*a*, 7*b* of the corresponding side end of the protective visor 6.

The hollows 29*a*, 29*b*, when engaged with the hooking teeth 7*a*, 7*b* of the protective visor 6, are shaped so as to allow the intermediate disc-shaped element 28 to rotate around the axis B-B, with respect to the support 23 of the lever body 18, and also to the base member 11 integrally with the visor 6, when the latter is raised or lowered. Therefore, the hollows 29*a*, 29*b* form removable constraining means for the hooking teeth 7*a*, 7*b* of the visor 6.

It must be noted that, even if the intermediate disc-shaped element has been described herein according to an embodiment which provides that two hollows 29*a*, 29*b* engage with two respective hooking teeth 7*a*, 7*b* of the protective visor 6, any other shape of such removable constraining means even with a single hooking tooth to hook the visor 6, for example elastic matching parts for the reversible retention, falls anyway within possible variations of the present invention.

The intermediate disc-shaped element 28 further comprises engaging means 31, 32, 33 integrally rotatable with the intermediate disc-shaped element 28 itself and suitable for reversibly snap fitting each time into at least one of the seats of the multiple-seat profile 24 of the support 23 of the lever body 18, during the raising or lowering of the protective visor 6.

It should be observed that "snap" means herein the particular manner in which the engaging means, such as a follower element with a respective projection, are engaged and retained within depressions or recesses defining the seats of the multiple-seat profile 24 such that, thanks to the elasticity of the engaging means and/or of the multiple-seat profile 24, such engaging means are stably retained within the respective seat until a force of suitable magnitude (and direction) applied to such means causes the elastic deformation or the elastic displacement of the engaging means and/or of the multiple-seat profile 24, thereby allowing the passage of the engaging means themselves from one seat to another of this multiple-seat profile 24.

In the particular embodiment shown herein, the aforementioned engaging means are of elastic type and comprise at least one piston 32 mounted for sliding within limits in a radial guide 31 of the intermediate disc-shaped element 28 and subject to the force of a spring 33 that pushes the piston 32 toward the outside of the same disc-shaped element 28, to engage with a respective multiple-seat profile 24.

In more detail, the intermediate disc-shaped element 28, having a substantially circular shape, has two diametrically opposite radial guides 31, each housing a respective piston 32 so that the latter slides within limits, for example thanks to stops or other means ceasing the radial stroke. As mentioned, each piston 32 is pushed towards the outside of the intermediate disc-shaped element 28 by a corresponding spring 33, so as to show a tip portion that is shaped to engage within at least one, or two, adjacent seats of the multiple-seat profile 24, to which is coupled.

During the rotation of the protective visor 6 around the axis B-B, the resulting rotation of the intermediate disc-shaped element 28 causes the snap movement, i.e. temporarily overcoming the force applied by the springs 33 of the pistons 32 within the respective guide 31, so as to allow those pistons 32 to be stably, although temporarily, housed in successive seats of the respective multiple-seat profiles 24 of which the support 23 of the lever body 18 is provided with. As will be apparent to the person skilled in the art, in this way a plurality of stable angular positions, defined by the number and distance of the seats of the profile 24, can be obtained for the protective visor 6 when the latter is raised or lowered by the user.

Finally, as mentioned, the protective visor 6 comprises next to at least one of its side ends, geometrically corresponding to the raising/lowering mechanism 10 illustrated herein, at least one hooking tooth 7*a*, 7*b* which, in the embodiment of the present invention illustrated herein, is constituted by an axial projection having a L-shaped profile and at least one follower projection 9 shaped as a pin and arranged on this visor 6 in order to engage in sliding contact with the cam guide 12 of the base member 11.

As will be further described hereafter, in the embodiment shown herein, the hooking teeth 7*a*, 7*b* of the protective visor 6 are shaped to be slidingly constrained within the fitting seats 21*a*, 21*b* (or housings having circular development) of the support 23 of the lever body 18 so as to rotate with respect to the latter, and to engage with the hollows 29*a*, 29*b* of the intermediate disc-shaped element 28 so as to integrally rotate with the latter around the axis B-B, whereas the follower projection 9 is shaped to engage with the guide cam 12 and, depending on the profile of the latter, to cause the lever body 18 to possibly swing around the axis A-A, according to a law of motion precisely determined by the drive cam 12.

In particular, in the embodiment of the protecting helmet 1 shown herein, the guide cam 12 is shaped so as to have an initial depressed portion for the follower projection 9, when the protective visor 6 is in its fully lowered position, then an intermediate elevated portion, and a further final depressed portion for this follower projection 9 when the visor 6 is arranged at its fully raised position. This geometry of the guide cam 12, together with the above described configuration of the raising/lowering mechanism 10 to raise/lower the protective visor 6, allows the lever body 18, thanks to the returning action of the spring 36, to be arranged in its distal position when the visor 6 is in its fully lowered position or in its fully raised position, and to be arranged instead in its proximal position when the visor 6 is in an intermediate position between these extremes, for example in a stable position determined by the multiple-seat profile 24.

It should be noted that, in an embodiment of the present invention not illustrated herein, the above said follower projection may be formed on the intermediate disc-shaped element 28 which, as mentioned, integrally rotates with the protective visor 6, for example in a manner protruding from the circular side wall of the disc-shaped element 28 itself and, as a result, the respective guide cam 12 may be formed on the inner side wall of the circular housing 13 of the base member 11.

Furthermore, according to a preferred aspect of the present invention, at least one tooth 7*a* of the hooking teeth 7*a*, 7*b* is of the type orthogonally projecting from the inner wall of at least one side end of the visor 6, i.e. axially and inwardly projecting from the latter, and comprises arched shoulders 8 shaped so as to facilitate the centering of the hooking tooth 7*a* within the corresponding fitting seat 21*a*, 21*b*, or circular housing, of the support 23 of the lever body 18. In particular, these arched shoulders 8 project from the inner face of the side end of the protective visor 6 only along a limited part of the entire height of the hooking tooth 7*a*.

As will be clear to the person skilled in the art also by reading the following description, such limited-in-height projections with arched shoulders 8, present on the hooking tooth 7*a*, are able to prevent the free linear translation of the protective visor 6 along the diametral direction linking the seats 21*a*, 21*b* and 25 of the lever body 18. Without them, a translational movement, even accidental, of the visor 6 in this direction may cause the cursor 26 to translate by overcoming the force applied by the spring 27 and allow the visor 6 itself to undesirably separate from the mechanism 10. On the other hand, due to such side projections of the arched shoulders 8, the only allowed movement of the visor 6 in the plane of the mechanism 10 is the rotation around the rotation axis B-B perpendicular to the plane itself.

Finally, the protecting helmet 1 of the present invention may also comprise an antiglare visor 6*b* (i.e. to protect against light rays) manually operable by the user of the helmet 1 itself thanks, for example, to a lever 37 rotatably mounted on the base member 11 and kinematically linked to such antiglare visor 6*b* so as to be able to lower or raise it with respect to the eye of the same user.

It is recalled that, according to a preferred aspect of the present invention, the protecting helmet 1 comprises two raising/lowering mechanisms 10 to raise/lower the visor 6, the two mechanisms, each located at one of the two sides of the front opening 5 of the helmet 1, having double rotation axis (A-A and B-B) and being, for example, substantially identical to each other.

Figure 5A:
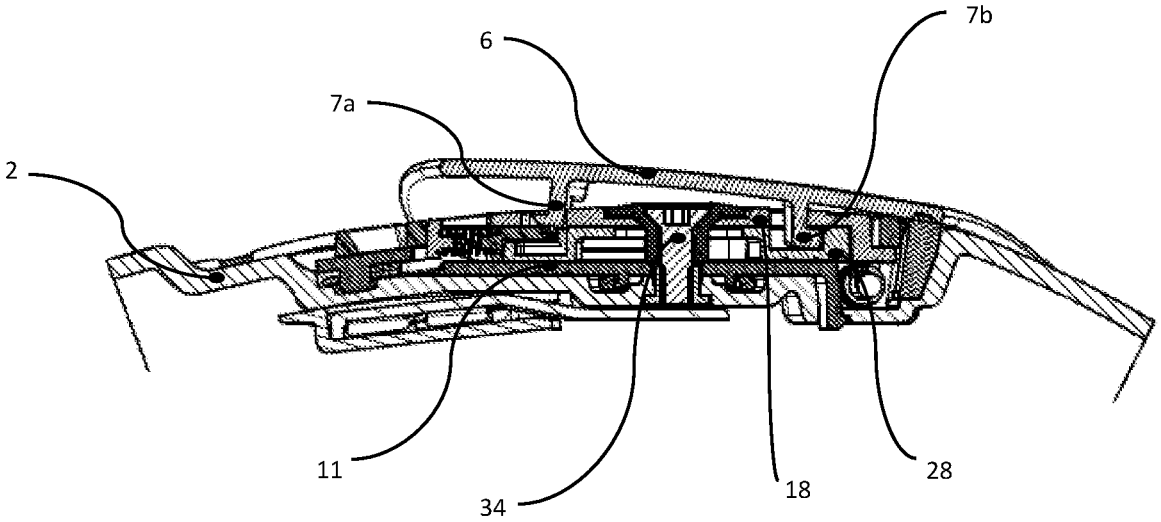
FIGS. 5*a*, 5*b* are sectional views schematically depicting the assembly of a side portion of a protective visor on a raising/lowering mechanism of the type shown in the preceding figures.
Figure 5B:
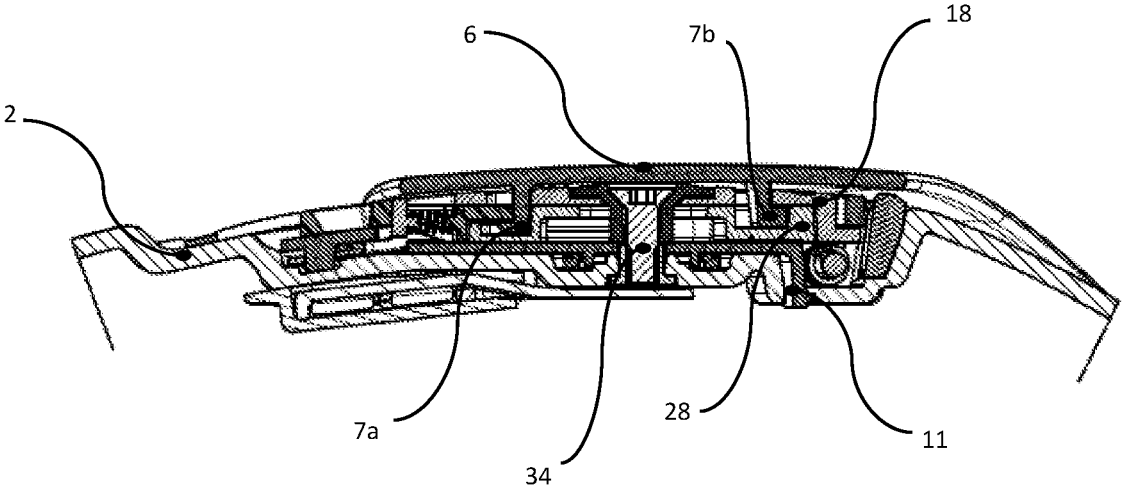

The protecting helmet 1 provided, on each side of the front opening 5, with a raising/lowering mechanism 10 to raise/lower the visor 6 illustrated herein with reference also to FIGS. 5*a* and 5*b*, works as follows.

Starting from a configuration of the protecting helmet 1 in which the protective visor 6 is separated from the raising/lowering mechanism 10 and therefore from the outer shell 2, first of all the visor 6 has to be mounted on the raising/lowering mechanism 10. In this regard, the visor 6 has to be first arranged in its fully raised position so as to position, per each side, the hooking teeth 7*a*, 7*b* at the inlets of the fitting seats, 21*a*, 21*b* or housing having a circular development of the support 23 of the lever body 18. In fact, it should be noted that the aforesaid inlets of the fitting seats 21*a*, 21*b* are shaped so that they geometrically match the hooking teeth 7*a*, 7*b* when the visor 6 is in the fully raised position, and that one of the inlets 25 of one of the fitting seats 21*a* is at least partially occluded by a cursor 26 provided with a tapered end at such inlet 25 and elastically pushed, for example and preferably by the spring 27, to engage with such inlet 25.

After inserting one of the hooking teeth 7*b* into the free inlet of the corresponding fitting seat 21*b* by tilting, lifting and suitably pressing the protective visor 6 with respect to the raising/lowering mechanism 10, the other hooking tooth 7*a* will be at the inlet 25 of the other fitting seat 21*a* partially obstructed by the elastic cursor 26. At this point it is only necessary to press axially, i.e. in the direction of the rotation axis B-B of the visor 6, the engagement tooth 7*a* against the tapered end of the elastic cursor 26 to cause the temporary displacement of the elastic cursor 26 itself in a direction substantially orthogonal to such rotation axis B-B, thereby clearing the inlet 25 of the fitting seat 21*a* of the lever body 18 and inserting—also—the hooking tooth 7*a* into such fitting seat 21*a*.

At some point in such hooking step to hook the visor 6 to the mechanism 10, also the limited-in-height projections of the arched shoulders 8, present on the hooking tooth 7*a*, reach and then pass the outer plane of the lever body 18 at the seat 21*a* that is precisely shaped so as to geometrically match also these side projections of the hooking tooth 7*a*. Then, the configuration of the teeth 7*a*, 7*b*, axially projecting and with L-shaped profile, allows the elastic return of the cursor 26 and therefore the retention of the teeth 7*a*, 7*b* in the circular-developed fitting seats 21*a*, 21*b* of the support 23 of the lever body 18.

It should be noted that the presence of the above mentioned arched shoulders 8 at the base of the hooking tooth 7*a* allows to facilitate the centering of the same hooking tooth 7*a* in the respective fitting seat 21*a* having circular development. Moreover, once the elastic cursor 26, pushed by the spring 27, is back to its normal position, the coupling created by the side end of the visor 6—through its projections orthogonal to the arched inner wall 7*a* with the protruding shoulders 8 and 7*b*—and the lever body 18 of the mechanism 10—through the corresponding seats 21*a*, 21*b*—exclusively allows the side end of the protective visor 6 itself to rotate around the axis B-B.

Simultaneously to this constraint the hooking teeth 7*a*, 7*b*, inserted in the seats 21*a*, 21*b*, reach the hollows 29*a*, 29*b* of the intermediate disc-shaped element 28 and engage therein, thus causing the protective visor 6 and this intermediate disc-shaped element 28 to be constrained to each other so as to integrally rotate around a rotation axis B-B defined, inter alia, by the above-mentioned fitting seats 21*a*, 21*b*. Moreover, once the elastic cursor 26, pushed by the spring 27, is back to its normal position, the coupling created by the side end of the visor 6—through its projections orthogonal to the arched inner wall 7*a* and 7*b* with the protruding shoulders 8 and 7*b*—and the lever body 18 of the mechanism 10—through the corresponding seats 21*a*, 21*b*—exclusively allows the side end of the visor 6 itself to rotate around the axis B-B.

Furthermore, still at the same time to what above described, the follower projection 9 of the side end of the visor 6 moves in abutment against, and couples with, the guide cam 12 of the base member 11 of the raising/lowering mechanism 10.

In this way, by repeating the same operation for the other side end of the protective visor 6, the latter is constrained to the raising/lowering mechanism 10 so as to be able to rotate integrally with the intermediate disc-shaped element 28 and with respect to the lever body 18 around an axis B-B, and at the same time to be able to swing, together with the support 23 of the lever body 18, with respect to the base member 11 around a different axis A-A, in this case the axis of the pin 16 around which the lever body 18 rotates, this swing being controlled by the engagement of the follower projection with the guide cam 12 of the base member 11 during the raising/lowering of the visor 6 operated by the user.

More particularly, after the assembly of the protective visor 6 on the mechanism 10, this visor 6 is in its upper and completely raised position with respect to the front opening 5 of the outer shell 2, thanks to the fact that the engagement of the follower projection 9 with the guide cam 12, having a depressed portion at this raised position of the visor 6, together with the return spring 36 acting on the lever body 18, cause the support 23 of the same lever body 18 to be arranged in its position distal from the front opening 5 of the protecting helmet 1, corresponding to a position of close proximity of the visor 6 with respect to the outer shell 2.

Starting from this fully raised position of the visor 6, the lowering rotation imparted by the user to the protective visor 6 itself causes, thanks to the shape of the guide cam 12—having as mentioned an intermediate elevated portion—and by overcoming the force of the return spring 36, the support 23 of the lever body 18 to swing around the axis A-A toward its position proximal to the front opening 5 of the helmet 1 and, at the same time, the simultaneous rotation of the visor 6 itself around the second axis B-B with respect to the body lever 18, integrally with the intermediate disc-shaped element 28. Therefore, throughout a given initial angular span during the lowering of the visor 6 from its fully raised position, this raising and rotation of the visor 6 itself with respect to the outer shell 2 of the helmet 1 is achieved thanks to a rotation of the visor 6 around the second axis B-B and the swing (rotation) of the latter with respect to the first axis A-A.

During this rotation around the two axes A-A and B-B, thanks to the swing of the support 23 of the lever body 18 with respect to the axis A-A, controlled by the guide cam 12, the visor 6 is raised with respect to the outer shell 2 towards its position proximal to the front opening of the helmet 5 and, at the same time, rotates together with the intermediate disc-shaped element 28 with respect to the same support 23 of the lever body 18.

It should be noted that, once the follower projection 9 of the visor 6 has reached the elevated middle portion of the guide cam 12, the rotation of the protective visor 6, during the lowering, continues as usual only around the afore said second axis B-B.

The rotation of the intermediate disc-shaped element 28, during the lowering of the visor 6, also causes the elastically-operated pistons 32 to suddenly—although potentially stably—snap fit into the seats of the multiple-seat profiles 24 of which the support 23 of the lever body 18 is provided with. In this way, a set of stable angular raising/lowering positions of the protective visor 6 can be defined with respect to the front opening 5 of the helmet 1.

It should be noted that, if the user wants to keep the protective visor 6 in a stable intermediate position, or suspend the lowering thereof in an angular position corresponding to an engaging position of the elastic pistons 32 within one of the seats of the multiple-seat profile 24, the forces applied to the visor 6, for example gravity or those of aerodynamic type, are countered by the engagement of these pistons 32 within the respective seat of the profile 24 shaped for example as a rack, without involving in this countering action any structural element of the protective visor 6 and therefore without needing that parts of the visor 6 undergo even considerable forces.

At the end of the lowering rotation of the visor 6 towards its position of complete, or almost complete, interference with the front opening 5 of the protecting helmet 1, the shape of the guide cam 12, which has a further depressed portion, causes a further swing of the support 23 of the lever body 18 around the axis A-A towards its position distal from the front opening 5, thanks to its engagement with the follower projection 9 of the same visor 6 and also thanks to the return spring 36. This causes, at the complete lowering of the protective visor 6, a new approach of the latter with respect to the outer shell 2 of the helmet 1.

The raising of the protective visor 6 towards its fully raised position takes place in a reverse way with respect to what described about its lowering.

That is, when the user raises the visor 6, in its initial and final raising steps the latter further undergoes a displacement away and then again towards the outer shell 2 of the helmet 1, both caused by the engagement of the follower projection 9 with the guide cam 12 and by the swing, subject to the returning action of the spring 36, of the support 23 of the lever body 18, in addition to a usual rotation around an axis B-B substantially orthogonal to the outer shell 2, the rotation also occurring in the intermediate step of the raising rotation.

Finally, if the user of the protecting helmet 1 wants to release the protective visor 6 from the raising/lowering mechanism 10 and thus from the outer shell 2, he/she just has to arrange this visor 6 in its fully raised position and then, by manually operating the elastic cursor 26, to make fully vacant the inlet 25 of the fitting seat 21*a*, at this point by properly tilting, raising and pulling the protective visor 6 in a direction substantially perpendicular to the plane of the raising/lowering mechanism 10 at one of the hooking teeth 7*a*, it is possible first of all to release and remove the limited-in-height side projections of the arched shoulders 8 present on the hooking tooth 7*a* itself from the fitting seat 21*a* of the lever body simultaneously releasing the apex of the tooth 7*a* from the seat 29*a* of the intermediate disc-shaped element 28 and, subsequently, to pull the hooking tooth 7*a* out of such fitting seat 21*a* and then disengage also the other tooth 7*b* from the respective inlet of the other fitting seat 21*b*.

Proceeding in this way for both the side ends of the visor 6 it is thus easily possible to remove the visor from the respective raising/lowering mechanisms 10.

It should be finally noted that the mechanism 10 can be easily assembled by substantially snapping it into place.

For this purpose the pistons 32, with the respective springs 33, are housed and retained in respective sliding guides 31 present in the intermediate disc-shaped element 28.

This intermediate assembly is inserted in the seat 23 of the lever body 18 by partially compressing the opposite pistons 32, and then by inserting also the cursor 26 with the respective spring 27 into a suitable seat of the same component 28.

At this point, the previous group of components is assembled on the base member 11 by taking care of passing the end 19 of the lever body 18 through the opening 15 in the base member 11 and by hooking the pin 16 into the hole 20; subsequently, by pressing the opposite end of the lever body 18, i.e. at the projection 42 thereof, against the base member, the elastic engagement is obtained between the projection 42 itself and the retaining wall 43 of the housing 13 of the base member 11. Of course, the projection 42 of the lever body 18 and/or the respective retaining wall 43 of the base member 11 are elastically deformable in order to allow such elastic coupling. It should be noted that, at this step, it is necessary to take care that the cursor 26 remains on the opposite surface of the base member 11.

Finally, by positioning the spring 36 between the cylindrical supports present both on the base member at the retaining wall 43 and on the lever body at the projection 42, the mechanism 10 is fully assembled and ready to be mounted on the side parts of the shell by means of a temporary positioning obtained through elastic hooks 40*a*, 40*b* and 41 and the final fastening by the bushing 35 and the rivet 34.

The invention claimed is:

1. A protecting helmet comprising an inner shell for shock absorption, an outer rigid shell that define a front opening for a face of a user, a protective visor rotatable between a lowered position partially intercepting the front opening and a raised position disengaged from said front opening, and a raising/lowering mechanism to raise/lower the protective visor, the raising/lowering mechanism comprising a) a base element integral with, or made in a single piece with, or coincident with, part of the outer shell, and arranged in a side position with respect to said front opening;

b) a lever body mounted on said outer shell or said base member so as to rotate around a first axis (A-A) and provided with a support swinging with respect to said first axis (A-A) between a proximal position and a distal position with respect to said front opening, said support further comprising hooking means to hook with a corresponding side area of the protective visor, and a multiple-seat profile;

c) elastic return-means constrained to said outer shell or said base member, and acting on said lever body to push the lever body towards said distal position;

d) one or more hooking teeth integral with said side area of the protective visor and shaped for engagement with said hooking means of the support of the lever body;

e) a guide cam and a respective follower projection engaged with said guide cam, said guide cam being integral with said base element, and said respective follower projection being constrained to integrally rotate with a first side area of the protective visor; and f) an intermediate disc-shaped element coupled with said support of said lever body to rotate around a second axis (B-B) of said support, and also to swing with respect to said first axis (A-A) integrally with said support of the lever body, said intermediate disc-shaped element comprising constraining means for providing removable constraint to said one or more hooking teeth of said protective visor in order to transmit at least a circular motion of the protective visor, during the raising or lowering of the protective visor, relative to said intermediate disc-shaped element, and engaging means, integrally rotatable with said intermediate disc-shaped element, and for a movable snap fitting with said multiple-seat profile.

2. The protecting helmet according to claim 1, wherein said raising/lowering mechanism comprises a pin and/or a mounting bush for axially retaining said lever body and said intermediate disc-shaped element in connection with said base member, said lever body and said intermediate disc-shaped element comprising elongated slots for the passage of the pin or mounting bush to allow the swing of said lever body and said intermediate disc-shaped element.

3. The protecting helmet according to claim 1, wherein said hooking means, of which the lever body is provided with, comprises housing, having a circular development, for the sliding of said one or more hooking teeth of the protective visor during the relative rotation of the protective visor with respect to the lever body.

4. The protecting helmet according to claim 3, wherein said housing having a circular development coincide with a fitting seat for said one or more hooking teeth.

5. The protecting helmet according to claim 1, wherein said hooking means to hook the lever body to a respective side area of the protective visor comprises a fitting seat for said one or more hooking teeth of the protective visor, said fitting seat being provided with an inlet that a manually operated elastic cursor can partially and selectively occlude.

6. The protecting helmet according to claim 1, wherein said one or more hooking teeth of the protective visor axially protrudes inwards from the side area of the protective visor and has arched shoulders.

7. The protecting helmet according to claim 1, wherein said lever body is constrained to the outer shell of the helmet by a pin.

8. The protecting helmet according to claim 1, wherein said engaging means for the snap fitting, of which the intermediate disc-shaped element comprises a piston sliding within limits in a respective radial guide and a thrust spring acting on said piston.

9. The protecting helmet according to claim 1, wherein said support of the lever body has a tubular shape with a substantially circular base and said intermediate disc-shaped element is partially housed in said tubular support.

10. The protecting helmet according to claim 1, wherein said base member is made separately from the outer shell and comprises a substantially circular housing-for said intermediate disc-shaped element, said housing having said guide cam on an outside.

11. The protecting helmet according to claim 1, wherein said elastic return-means comprises a helical spring.

12. The protecting helmet according to claim 1, wherein said multiple-seat profile is a rack.

13. The protecting helmet according to claim 1, further comprising an antiglare visor.

14. The protecting helmet according to claim 13, further comprising a manually operated lever for said second visor.

15. The protecting helmet according to claim 1, further comprising a second raising/lowering mechanism to raise/lower the protective visor which is located at both sides of the front opening of the helmet.

* * * * *